US007856770B2

(12) United States Patent
Grassmuck et al.

(10) Patent No.: US 7,856,770 B2
(45) Date of Patent: Dec. 28, 2010

(54) MULTI-PANE GLASS ASSEMBLY FOR A REFRIGERATED DISPLAY CASE

(75) Inventors: Michael D. Grassmuck, Chesterfield, MO (US); Garrick N. McFarland, Granite City, IL (US); John D. Withouse, Bland, MO (US)

(73) Assignee: Hussmann Corporation, Bridgeton, MO (US)

( * ) Notice: Subject to any disclaimer, the term of this patent is extended or adjusted under 35 U.S.C. 154(b) by 1646 days.

(21) Appl. No.: 10/930,643

(22) Filed: Aug. 31, 2004

(65) Prior Publication Data

US 2006/0059861 A1 Mar. 23, 2006

(51) Int. Cl.
*E06B 7/00* (2006.01)
*E06B 3/00* (2006.01)
*E04C 2/54* (2006.01)

(52) U.S. Cl. ..... 52/204.593; 52/786.1; 52/786.11; 428/34

(58) Field of Classification Search ..... 52/204.593, 52/204.6, 173.1, 786.13, 786.1, 786.11; 62/246; 312/116; 428/34
See application file for complete search history.

(56) References Cited

U.S. PATENT DOCUMENTS 1,223,761 A * 4/1917 Brown ..... 52/479
1,629,408 A 5/1927 Peacock
1,728,984 A 9/1929 Starr
1,742,624 A * 1/1930 Weber ..... 62/253
1,867,074 A 7/1932 Hill
1,956,102 A 4/1934 Long
2,052,244 A * 8/1936 Pertz ..... 52/786.13
2,177,001 A 10/1939 Owen
2,205,522 A * 6/1940 Fix ..... 52/203
3,499,245 A 3/1970 Winsler et al.
3,553,913 A * 1/1971 Eisenberg ..... 52/172
4,035,608 A 7/1977 Stromquist et al.
4,149,348 A * 4/1979 Pyzewski ..... 52/172
4,253,286 A * 3/1981 Katona ..... 52/171.1
4,459,789 A * 7/1984 Ford ..... 52/656.5
4,464,874 A * 8/1984 Shea et al. ..... 52/204.593

(Continued)

FOREIGN PATENT DOCUMENTS

DE 8311805 8/1983

(Continued)

OTHER PUBLICATIONS

Efficient Windows Collaborative, Window Technologies: Low-E Coatings, http://www.efficientwindows.org/low.cfm, Nov. 2, 2004.

(Continued)

*Primary Examiner*—Richard E Chilcot, Jr.
*Assistant Examiner*—Charissa Ahmad
(74) *Attorney, Agent, or Firm*—Michael Best & Friedrich LLP

(57) ABSTRACT

A glass assembly for a refrigerated display case. In some embodiments, the glass assembly includes a first pane having a first edge, a second pane substantially parallel to the first pane having a second edge substantially aligned with the first edge, and a third pane substantially parallel with the first pane and the second pane. The third pane includes a third edge offset from the second edge and defines a step in the glass assembly.

14 Claims, 3 Drawing Sheets

U.S. PATENT DOCUMENTS

| | | | | |
|---|---|---|---|---|
| 4,494,342 | A * | 1/1985 | Decker | 52/203 |
| 4,624,091 | A * | 11/1986 | Biro | 52/656.5 |
| 4,818,043 | A * | 4/1989 | Borgen | 312/138.1 |
| 4,977,754 | A | 12/1990 | Upton et al. | |
| 5,024,023 | A | 6/1991 | Kostos et al. | |
| 5,107,655 | A * | 4/1992 | Lindgren | 52/786.1 |
| 5,111,618 | A | 5/1992 | Kaspar et al. | |
| 5,255,473 | A | 10/1993 | Kaspar et al. | |
| 5,363,611 | A * | 11/1994 | Richardson et al. | 312/116 |
| 5,531,047 | A * | 7/1996 | Leopold et al. | 52/172 |
| 5,553,440 | A * | 9/1996 | Bulger et al. | 52/786.13 |
| 5,644,894 | A * | 7/1997 | Hudson | 52/786.13 |
| 5,653,073 | A | 8/1997 | Palmer | |
| 6,108,999 | A * | 8/2000 | Smith et al. | 52/786.1 |
| 6,250,026 | B1 * | 6/2001 | Thompson, Jr. | 52/172 |
| 6,286,288 | B1 * | 9/2001 | France | 52/786.1 |
| 6,289,641 | B1 * | 9/2001 | McCandless | 52/172 |
| 6,333,085 | B1 | 12/2001 | Emek | |
| 6,367,223 | B1 * | 4/2002 | Richardson et al. | 52/656.9 |
| 6,393,768 | B1 | 5/2002 | Roche et al. | |
| 6,401,428 | B1 | 6/2002 | Glover et al. | |
| 6,435,630 | B1 * | 8/2002 | Anin et al. | 312/116 |
| 6,477,812 | B2 * | 11/2002 | Boone et al. | 52/172 |
| 6,509,071 | B1 * | 1/2003 | Emek | 428/34 |
| 6,606,833 | B2 * | 8/2003 | Richardson et al. | 52/204.5 |
| 6,612,091 | B1 * | 9/2003 | Glover et al. | 52/786.1 |
| 6,637,093 | B2 | 10/2003 | Richardson et al. | |
| 6,886,297 | B1 * | 5/2005 | Crandell | 52/172 |
| 6,974,518 | B2 * | 12/2005 | Hornung et al. | 156/109 |
| 7,100,343 | B2 * | 9/2006 | France | 52/786.1 |
| 7,213,375 | B2 * | 5/2007 | Morgan et al. | 52/204.6 |
| 7,765,769 | B2 * | 8/2010 | Rosskamp et al. | 52/786.1 |
| 2002/0046545 | A1 * | 4/2002 | France | 52/786.1 |
| 2003/0062813 | A1 | 4/2003 | Cording | |
| 2004/0231255 | A1 * | 11/2004 | Silverman | 52/204.6 |
| 2005/0126091 | A1 * | 6/2005 | Sherrett et al. | 52/204.6 |
| 2006/0218875 | A1 * | 10/2006 | Hornung et al. | 52/786.13 |
| 2006/0260229 | A1 * | 11/2006 | McKinlay et al. | 52/204.593 |

FOREIGN PATENT DOCUMENTS

| | | | |
|---|---|---|---|
| DE | 3228558 | A1 * | 2/1984 |
| DE | 3316872 | A1 * | 11/1984 |
| DE | 3810200 | A1 * | 10/1989 |
| DE | 3818543 | A1 * | 12/1989 |
| EP | 78530 | A2 * | 5/1983 |
| EP | 418461 | A1 * | 3/1991 |
| JP | 60129387 | A * | 7/1985 |

OTHER PUBLICATIONS

Efficient Windows Collaborative, Window Technologies: Low Conductance Spacers, http://www.efficientwindows.org/spacers.cfm, Nov. 2, 2004.

Efficient Windows Collaborative, Window Technologies: Argon or Krypton Gas Fills, http://www.efficientwindows.org/gasfills.cfm, Nov. 2, 2004.

Description of prior art glass assemblies publicly known prior to Aug. 31, 2003.

* cited by examiner

MULTI-PANE GLASS ASSEMBLY FOR A REFRIGERATED DISPLAY CASE

FIELD OF THE INVENTION

This invention relates to a multi-pane glass assembly for a refrigeration unit. More particularly, this invention relates to a multi-pane glass assembly and the heat transfer path through the glass assembly.

BACKGROUND OF THE INVENTION

Typically, refrigerated display cases with multi-pane glass assemblies require supplemental heat to prevent the formation of condensation on an outer pane of the multi-pane glass assembly. Supplemental heat is commonly supplied to the surface and/or perimeter of the glass panes. As a result, the overall energy consumption of the refrigerated display case is increased.

FIGS. 1 and 2 illustrate prior art glass assemblies 11, 51 for refrigerated display cases 10, 50. FIG. 1 shows a refrigerated display case 10 having a glass assembly 11 coupled to an insulated wall 12 with an extruded member 14. The glass assembly 11 includes a first pane of glass 16 having a first edge 18, a second pane of glass 20 having a second edge 22, and a third pane of glass 24 having an outer surface 25 and a third edge 26. The second pane 20 is separated from the first pane 16 to define a first air space 17, and the second pane 20 is separated from the third pane 24 by a second air space 19. A first spacer 28 is positioned within the first air space 17 adjacent the first and second edges 18, 22, and a second spacer 30 is positioned within the second air space 19 adjacent the second and third edges 22, 26. The first edge 18, the second edge 22 and the third edge 26 are all substantially aligned to form a perimeter edge 31 of the glass assembly 11.

The extruded member 14 is constructed of plastic and/or aluminum and includes a first portion 32 that engages the insulated wall 12, and a second portion 34 that engages the glass assembly 11 to couple the glass assembly 11 to an outer edge 36 of the insulated wall 12. The insulated wall 12 has a thickness X ranging from about 1.5 inches to about 2 inches. The glass assembly 11 has a thickness Y ranging from about 1.0 inches to about 1.5 inches. The glass assembly 11 is spaced a distance from the first portion 32 of the extruded member 14 to define a perimeter space 38 between the glass assembly 11 and the extruded member 14.

The third pane 24 is positioned adjacent the environment, and the first pane 16 is positioned adjacent a low temperature interior of the refrigerated display case 10. As a result, a highly-conductive heat transfer path P1 is defined through the glass assembly 11 by the first pane 16, the first spacer 28, the second pane 20, the second spacer 30, and the third pane 24. Specifically, heat is conducted from the environment through the third pane 24, the second spacer 30, the second pane 20, the first spacer 28, and the first pane 16 in a substantially linear path through the glass assembly 11 (i.e., from left to right in FIG. 1). As a result, condensation forms on the outer surface 25 of third pane 24 and/or an outwardly-facing portion of the extruded member 14 adjacent the third edge 26 of the third pane 24. A perimeter heater 40 is positioned in the perimeter space 38 between the glass assembly 11 and the extruded member 14 to counteract the results of the heat transfer path P1 through the glass assembly 11 and minimize the amount of condensation that forms on the outer surface 25 of the third pane 24 and/or the extruded member 14.

FIG. 2 shows another prior art refrigerated display case 50 having a glass assembly 51 positioned within a recess 53 of an insulated wall 52 of the refrigerated display case 50. The glass assembly 51 shown in FIG. 2 is coupled to the recess 53 with an extruded member 54.

The glass assembly includes a first pane 56 having a first edge 58, a second pane 60 having a second edge 62, and a third pane 64 having an outer surface 65 and a third edge 66. The second pane 60 is separated from the first pane 56 to define a first air space 57, and the second pane 60 is separated from the third pane 64 by a second air space 59. A first spacer 68 is positioned within the first air space 57 adjacent the first and second edges 58, 62, and a second spacer 70 is positioned within the second air space 59 adjacent the second and third edges 62, 66. The first edge 58, the second edge 62 and the third edge 66 are all substantially aligned to form a perimeter edge 71 of the glass assembly 51. The perimeter edge 71 of the glass assembly 51 is positioned within the recess 53 adjacent a bottom 73 of the recess 53 when the glass assembly 51 is installed in the insulated wall 52.

The third pane 64 is positioned adjacent the environment, and the first pane 56 is positioned adjacent a low temperature interior of the refrigerated display case 50. A conductive heat transfer path P2 is formed by the first pane 56, the first spacer 68, the second pane 60, the third spacer 70 and the third pane 64. However, the heat transfer path P2 is substantially embedded within the insulated wall 52. The glass assembly 51 has a thickness Y' ranging from about 1.0 inches to about 1.5 inches. To provide adequate strength, support and insulation to the glass assembly 51, the insulation wall 52 has a thickness X' greater than that required for prior art refrigerated display cases, such as the prior art refrigerated display case 10 illustrated in FIG. 1. Particularly, the thickness X' is greater than 2 inches. Provided the thickness X' of the insulated wall 52 is thick enough to properly insulate the elements that define the heat transfer path P2 from the environment, condensation should not form on the outer surface 65 of the third pane 64, and supplemental heat should not be required to be supplied to the third pane 64.

SUMMARY OF THE INVENTION

In some embodiments of the present invention, a glass assembly for a refrigerated display case is provided. The refrigerated display case has an insulated wall that separates a low temperature region of the refrigerated display case from the environment. The glass assembly can include a first pane having a first edge adapted to be positioned within the insulated wall. The glass assembly can further include a second pane substantially parallel with respect to the first pane. The second pane can be positioned a distance from the first pane to define a first space. The second pane can include a second edge adapted to be positioned within the insulated wall, and which is substantially aligned with the first edge. The glass assembly can further include a third pane substantially parallel with respect to the first pane and the second pane. The third pane can be positioned a distance from the second pane to define a second space. The third pane can include a third edge adapted to be positioned outside of the insulated wall, such that the third edge is offset from the second edge and defines a step in the glass assembly.

Some embodiments of the present invention provide a glass assembly for a refrigerated display case. The glass assembly can include a first pane extending in a first direction, and a second pane substantially parallel with respect to the first pane and also extending in the first direction. The second pane can be spaced a distance from the first pane along a second direction oriented substantially orthogonally to the first pane and the second pane to define a first space between the first pane and the second pane. A first spacer can be positioned in the first space. The glass assembly can further include a third pane substantially parallel with the first pane and the second pane and also extending in the first direction. The third pane can be spaced a distance from the second pane along the second direction to define a second space between the second pane and the third pane. A second spacer can be positioned in the second space, such that the second spacer is offset from the first spacer in the first direction.

In some embodiments of the present invention, a refrigerated display case is provided. The refrigerated display case generally includes an insulated wall and a glass assembly. The insulated wall can be positioned to separate a low temperature interior of the refrigerated display case from the environment. The insulated wall can include a perimeter wall having a recess. The glass assembly can be at least partially supported by the perimeter wall between the low temperature interior of the refrigerated display case and the environment. The glass assembly can include a first pane at least partially positioned within the recess, and a second pane substantially parallel with respect to the first pane. The second pane can be at least partially positioned within the recess. The second pane can be spaced a distance from the first pane to define a first space. The glass assembly can further include a third pane substantially parallel with respect to the first pane and the second pane. The third pane can be positioned outside of the recess to define a step in the glass assembly.

Other features and aspects of the invention will become apparent to those skilled in the art upon review of the following detailed description, claims, and drawings.

Figure 1:
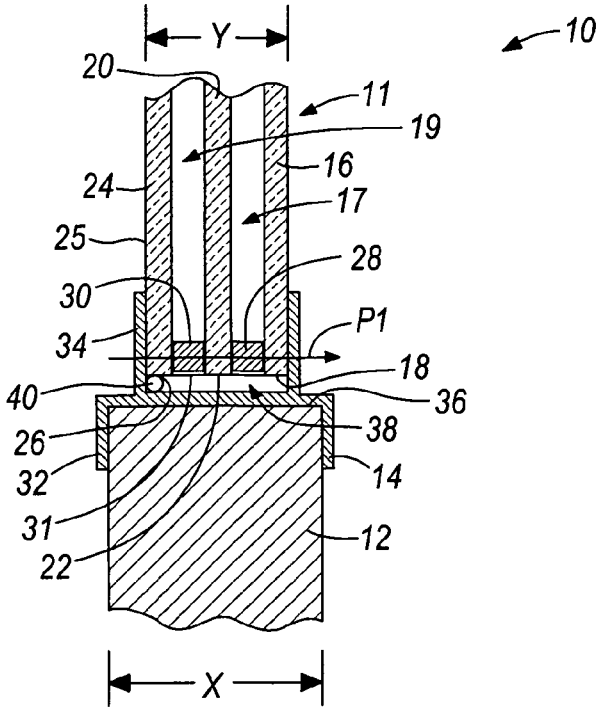
FIG. 1 PRIOR ART
FIG. 1 is a partial cross-sectional view of a prior art refrigerated display case.
Figure 2:
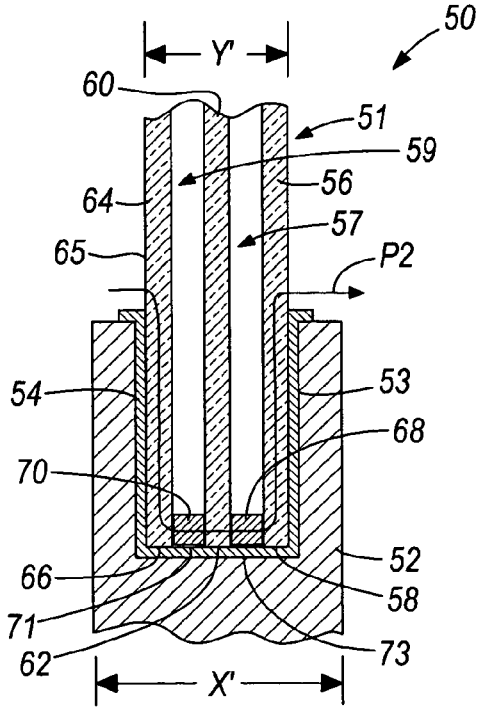
FIG. 2 PRIOR ART
FIG. 2 is a partial cross-sectional view of another prior art refrigerated display case.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings. Furthermore, terms such as "front," "rear," "top," "bottom," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

DETAILED DESCRIPTION

Figure 3:
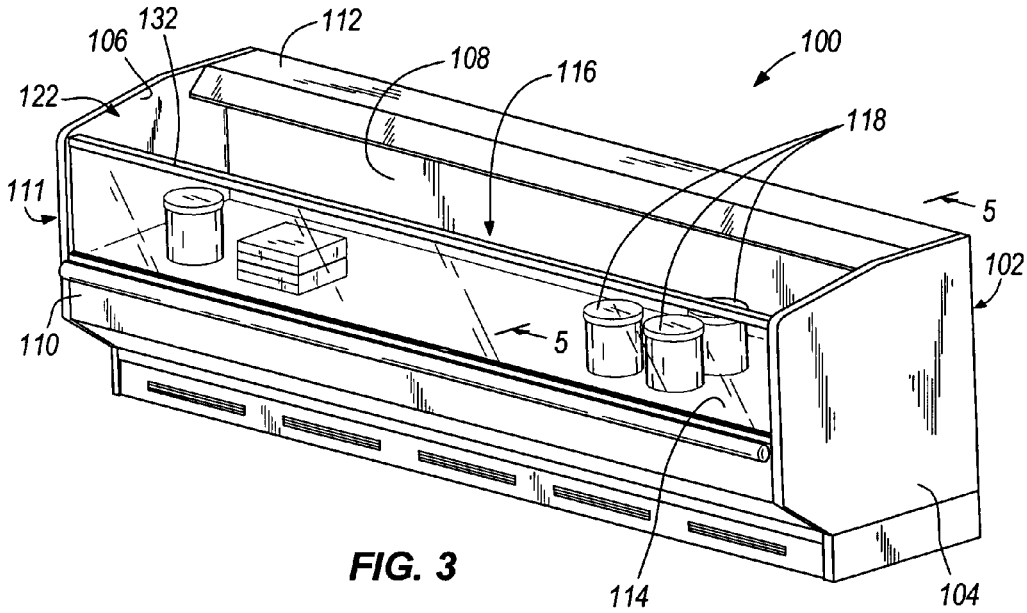
FIG. 3 is perspective view of a refrigerated display case according to one embodiment of the present invention, the refrigerated display case having a glass assembly and an insulated wall.
Figure 4:
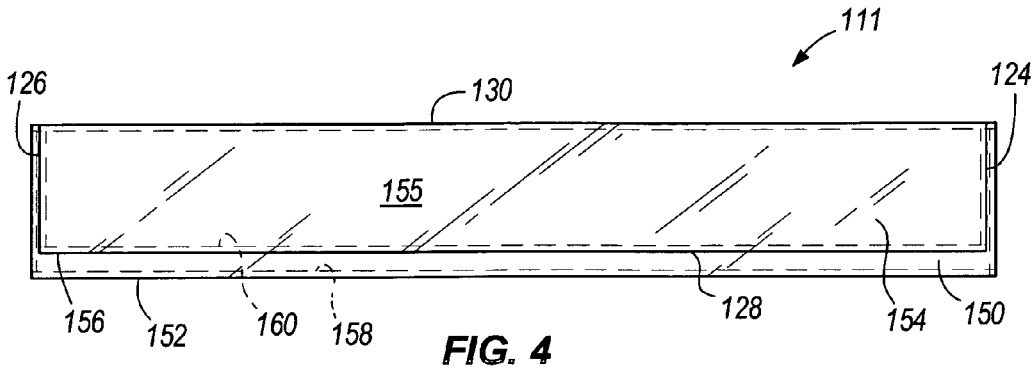
FIG. 4 is a front view of the glass assembly of the refrigerated display case of FIG. 3.
Figure 5:
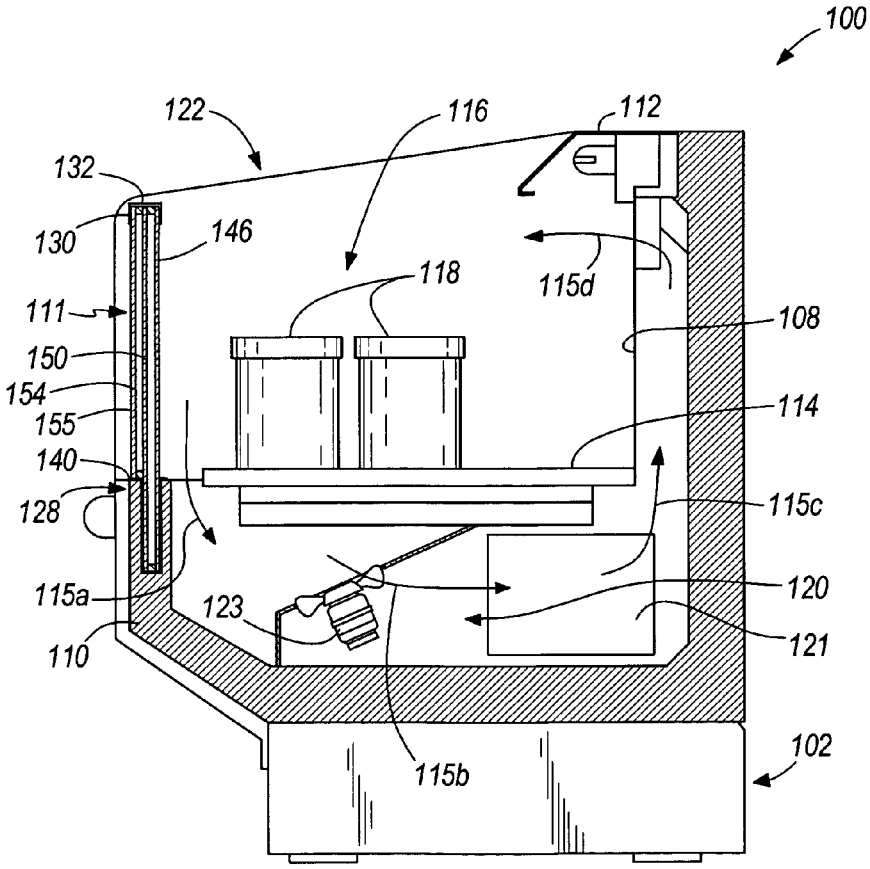
FIG. 5 is a cross-sectional view of the refrigerated display case of FIG. 3, taken along line 5-5.

FIG. 3-6 illustrate a refrigerated display case 100 according to one embodiment of the present invention. As illustrated in FIGS. 3-5, the refrigerated display case 100 includes a housing 102 having a right insulated wall 104, a left insulated wall 106, a back insulated wall 108, a front insulated wall 110, a glass assembly 111, a partial ceiling 112, and a floor 114 that together define a product display area or a low temperature interior 116 of the refrigerated display case 100. A variety of products 118 can be stored in the low temperature interior 116 to be refrigerated and displayed. The insulated walls 104, 106, 108, 110, the glass assembly 111, and the partial ceiling 112 are all positioned to separate the low temperature interior 116 of the refrigerated display case 100 from the environment. The insulated walls 104, 106, 108, 110 can be formed of a variety of materials, including metal, plastic, and combinations thereof.

As shown in FIG. 5, a portion of a refrigeration unit 120 including an evaporator assembly 121 and a fan 123 is positioned under the floor 114 in the refrigerated display case 100. The refrigeration unit 120 draws in warmed air (115*a*) from the low temperature interior 116, cools it (115*b*, 115*c*), and discharges cooled air (115*d*) into the low temperature interior 116 to create an airflow throughout the low temperature interior 116. The glass assembly 111 and the partial ceiling 112 are separated from one another at the top of the refrigerated display case 100 to define an opening 122. The airflow created by the refrigeration unit 120 establishes an air curtain that moves substantially over the opening 122 to allow the low temperature interior 116 to remain at a temperature lower than the environment.

As illustrated in FIGS. 3-6, the glass assembly 111 is stepped and dimensioned such that a portion of the glass assembly 111 is received within the right insulated wall 104, the left insulated wall 106, and the front insulated wall 110. The glass assembly 111 includes four edges: a right stepped edge 124 that is adapted to be received within the right insulated wall 104, a left stepped edge 126 that is adapted to be received within the left insulated wall 106, a bottom stepped edge 128 that is adapted to be received within the front insulated wall 110, and a flat top edge 130. The flat top edge 130 is adapted to be covered by a rail 132 to create a flat upper edge to the glass assembly 111 for aesthetics and easy access to the products 118. However, the top edge 130 of the glass assembly 111 can instead by stepped, similar to the other edges 124, 126, and 128.

Figure 6:
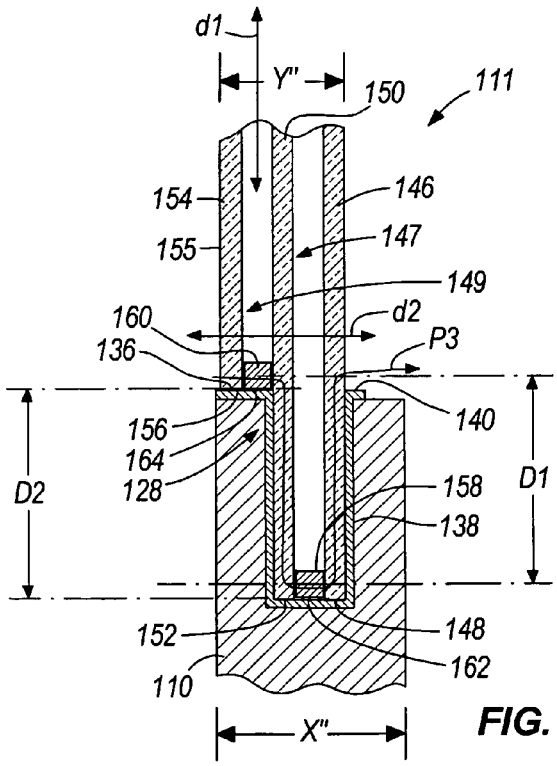
FIG. 6 is an enlarged cross-sectional view of the glass assembly and insulated wall of the refrigerated display case of FIGS. 3 and 5.

FIGS. 5 and 6 illustrate a cross-section of the refrigerated display case 100. FIG. 6 illustrates a close-up view of a cross-section of the lower stepped edge 128 of the glass assembly 111 and a portion of the front insulated wall 110. The low temperature interior 116 of the refrigerated display case 100 is positioned to the right of the glass assembly 111 and the front insulated wall 110 in FIGS. 5 and 6, and the environment is positioned to the left of the glass assembly 111 and the front insulated wall 110 in FIGS. 5 and 6.

With continued reference to FIGS. 5 and 6, the front insulated wall 110 includes an upper surface 136 having a recess 138 defined therein. An extruded member 140 is shaped to be received within the recess 138 and fits adjacent the stepped bottom edge 128 of the glass assembly 111, such that the extruded member 140 is disposed between the glass assembly 111 and the front insulated wall 110. However, the extruded member 140 is not required in the present invention, and the glass assembly 111 can be directly coupled to the front insulated wall 110 without departing from the spirit and scope of the present invention. In embodiments employing the extruded member 140, the extruded member 140 can be formed of a variety of materials, including a metal, a polymer, and combinations thereof.

The glass assembly 111 includes a first pane 146 having a first edge 148, a second pane 150 having a second edge 152, and a third pane 154 having an outer surface 155 and a third edge 156. The first pane 146, the second pane 150, and the third pane 154 can be formed of a variety of transparent or translucent materials including, without limitation, glass, polycarbonate, acrylic, vinyl, and combinations thereof. Furthermore, any portion of at least one of the first pane 146, the second pane 150, and the third pane 154 can be coated with a low-emittance ("low-E") coating to reduce radiant heat transfer.

As best shown in FIG. 6, the first pane 146, the second pane 150, and the third pane 154 all extend in a first direction d1 (e.g., vertical) and are substantially parallel with respect to one another. The second pane 150 is spaced a distance from the first pane 146 in a second direction d2 (e.g., horizontal) that is substantially perpendicular to the first direction d1 and substantially orthogonal to the first pane 146 and the second pane 150 to define a first space 147. Similarly, the third pane 154 is spaced a distance from the second pane 150 in the second direction d2 to define a second space 149. The first space 147 and the second space 149 can be filled with air or a variety of heavier, slower moving gases, such as argon, krypton, and combinations thereof.

A first spacer 158 is positioned in the first space 147 adjacent the first edge 148 and the second edge 152 and adjacent a bottom of the recess 138. A second spacer 160 is positioned outside of the recess 138 in the second space 149 between the second pane 150 and the third pane 154 adjacent the third edge 156. The first and second spacers 158, 160 can be constructed of a variety of materials including, without limitation, a metal (e.g., aluminum, stainless steel, and the like), a polymer, and combinations thereof.

A heat transfer path P3 through the glass assembly 111 is defined by the first pane 146, the first spacer 158, the second pane 150, the second spacer 160, and the third pane 154. Specifically, heat is conducted from the environment through the third pane 154, the second spacer 160, the second pane 150, the first spacer 158, and the first pane 146 (i.e., generally from left to right in FIGS. 5 and 6). As illustrated in FIGS. 5 and 6, the heat transfer path P3 is not linear in the second direction d2. That is, as a result of the first spacer 158 being offset from the second spacer 160 in the first direction d1 by a distance D1, at least a portion of the heat transfer path P3 extends substantially along the first direction d1. By elongating the heat transfer path P3 in this manner, condensation is substantially prevented from forming on the outer surface 155 of the third pane 154. In addition, no supplemental heat source is required to supply heat to any portion of the glass assembly 111 (including the first pane 146, the second pane 150 and the third pane 154), or any portion of the front insulated wall 110.

The distance D1 that the first spacer 158 is offset from the second spacer 160 in the first direction d1 can be modified depending on the desired heat transfer path P3, and the offset distance D1 illustrated in FIGS. 4-6 is illustrated by way of example only. The first spacer 158 does not need to be positioned adjacent the first edge 148 and the second edge 152, and the second spacer 160 does not need to be positioned adjacent the third edge 156, as long as the second spacer 160 is offset from the first spacer 158 to define a step in the heat transfer path P3 through the glass assembly 111.

The first edge 148 and the second edge 152 are substantially aligned to at least partially define a first perimeter edge 162 of the glass assembly 111 that is dimensioned to be received within the recess 138 when the glass assembly 111 is installed in the front insulated wall 110. The third edge 156 is offset in the first direction d1 from the first perimeter edge 162 to at least partially define a second perimeter edge 164 of the glass assembly 111. The second perimeter edge 164 is adapted to be positioned outside of the recess 138 adjacent the upper surface 136 when the glass assembly 111 is installed in the front insulated wall 110. Thus, the third edge 156 is offset from the first edge 148 and the second edge 152 to define a step in the glass assembly 111, and particularly, the stepped bottom edge 128. In the embodiment illustrated in FIGS. 4-6, the third edge 156 is offset from the second edge 152 by a distance D2 substantially similar to the distance D1 the second spacer 160 is offset from the first spacer 158. However, in other embodiments, the second spacer 160 is offset from the first spacer 158 by a distance D1 different from the distance D2 that the third edge 156 is offset from the second edge 152.

As a result of the step formed in the glass assembly 111, a portion of the thickness Y" of the glass assembly 111 is received within the recess 138 of the front insulated wall 110, while a portion of the thickness Y" of the glass assembly 111 is positioned outside of the recess 138. That is, the entire thickness Y" does not need to fit within the recess 138. Accordingly, the front insulated wall 110 can have a thickness X" of about 1.5 inches to about 2 inches. The thickness Y" of the glass assembly 111 can range from about 1.0 inches to about 1.5 inches.

As illustrated in FIG. 4, the glass assembly 111 can include a similar configuration of panes 146, 150, 154 and spacers adjacent the right stepped edge 124 and the left stepped edge 126 of the glass assembly 111. Accordingly, the right insulated wall 104 and the left insulated wall 106 can include a recess defined therein and dimensioned to receive at least a portion of the right stepped edge 124 and the left stepped edge 126, respectively.

As illustrated in FIGS. 5 and 6, the first pane 146 is positioned adjacent the low temperature interior 116 of the refrigerated display case 100, and the third pane 154 is positioned adjacent the environment. In this embodiment, the stepped right edge 124, the stepped left edge 126, and the stepped bottom edge 128 are directed outwardly of the refrigerated display case 100 (i.e., the outer pane does not extend as far as the inner pane in the first direction d1). However, in some embodiments of the present invention, the third pane 154 can be positioned adjacent the low temperature interior 116 of the refrigerated display case 100, and the first pane 146 can be positioned adjacent the environment. That is, in some embodiments, one or more of right stepped edge 124, the left stepped edge 126, and the bottom stepped edge 128 can face inwardly with respect to the refrigerate display case 100. In addition, the steps in the stepped edges 124, 126, 128 do not all need to face in the same direction (i.e., all inwardly or all outwardly with respect to the refrigerated display case 100). For example, the right stepped edge 124 and the left stepped edge 126 can be directed inwardly toward the low temperature interior 116, and the bottom stepped edge 128 can be directed outwardly from the low temperature interior 116.

The glass assembly 111 can include more than three panes 146, 150, 154 and two spacers 158, 160. In some embodiments, the glass assembly 111 can include four or more panes and three or more spacers. In such embodiments, adjacent spacers are offset from one another to elongate the heat transfer path P3 through the glass assembly 111. In addition, adjacent panes can be offset from one another to minimize the requisite wall thickness of an insulated wall in which the glass assembly 111 is to be installed.

The refrigerated display case 100 illustrated in FIGS. 3-6 is a horizontal freezer shaped to allow users to access the products 118 through the opening 122. The glass assembly 111 forms a window at the front of the refrigerated display case 100 to improve visibility of the products 118. However, the refrigerated display case 100 is shown by way of example only. The glass assembly 111 of the present invention can be used in doors and windows of a variety of coolers, freezers and hot food cases, including, without limitation, island cases, upright cases, and self service cases.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A glass assembly for a refrigerated display case, the glass assembly comprising:

a first pane extending in a first direction and including a first edge;

a second pane substantially parallel with respect to the first pane and extending in the first direction, the second pane including a second edge and spaced a distance from the first pane along a second direction oriented substantially orthogonally to the first pane and the second pane to define a first space between the first pane and the second pane;

a first spacer positioned in the first space adjacent the first edge and the second edge;

a third pane substantially parallel with the first pane and the second pane and extending in the first direction, the third pane including a third edge and spaced a distance from the second pane along the second direction to define a second space between the second pane and the third pane; and a second spacer positioned in the second space, the second spacer offset from the first spacer in the first direction such that the first spacer and the second spacer are not aligned with and do not overlap each other in the first direction.

2. The glass assembly of claim 1, wherein the second spacer is positioned adjacent the third edge to define a step in the glass assembly.

3. The glass assembly of claim 1, further comprising a heat transfer path defined by the first pane, the first spacer, the second pane, the second spacer, and the third pane, and wherein the heat transfer path is not linear between the first spacer and the second spacer in the second direction.

4. The glass assembly of claim 1, wherein at least a portion of at least one of the first pane, the second pane, and the third pane is coated with a low-E material.

5. The glass assembly of claim 1, wherein at least one of the first space and the second space is filled with at least one of argon gas and krypton gas.

6. The glass assembly of claim 1, wherein the thickness of the glass assembly in the second direction is between about 1.0 inches and 1.5 inches.

7. A refrigerated display case comprising:

an insulated wall positioned to separate a low temperature interior of the refrigerated display case from the environment, the insulated wall including a perimeter wall having a recess; and a glass assembly at least partially supported by the perimeter wall between the low temperature interior of the refrigerated display case and the environment, the glass assembly including a first pane at least partially positioned within the recess, a second pane substantially parallel with respect to the first pane and at least partially positioned within the recess, the second pane spaced a distance from the first pane to define a first space, a third pane substantially parallel with respect to the first pane and the second pane, the third pane positioned outside of the recess to define a step in the glass assembly, the third pane not covered by any portion of the perimeter wall and spaced a distance from the second pane to define a second space, a first spacer positioned in the recess within the first space between the first pane and the second pane, and a second spacer positioned within the second space between the second pane and the third pane, wherein the second spacer is outside the recess and offset from the first spacer such that the first spacer and the second spacer are not aligned with and do not overlap each other.

8. The refrigerated display case of claim 7, wherein the refrigerated display case does not include a supplemental heat source supplying supplemental heat to any of the first pane, the second pane, the third pane, and the perimeter wall.

9. The refrigerated display case of claim 7, wherein the first pane is positioned adjacent the low temperature interior of the refrigerated display case.

10. The refrigerated display case of claim 7, further comprising an extruded member disposed between the glass assembly and the insulated wall.

11. The refrigerated display case of claim 7, wherein the thickness of the insulated wall is between about 1.5 inches and about 2 inches.

12. The refrigerated display case of claim 7, further comprising a low-E coating on at least one of the first pane, the second pane and the third pane.

13. The refrigerated display case of claim 7, wherein at least one of the first space and the second space is filled with at least one of argon gas and krypton gas.

14. The refrigerated display case of claim 7, wherein the third pane includes an edge that is exposed to the environment.

* * * * *